United States Patent [19]

van Dongen et al.

[11] Patent Number: 4,682,421

[45] Date of Patent: Jul. 28, 1987

[54] METHOD FOR DETERMINING THE AZIMUTH OF A BOREHOLE

[75] Inventors: Johannes C. M. van Dongen; Leo B. Maekiaho, both of Rijswijk, Netherlands

[73] Assignee: Shell Oil Company, Houston, Tex.

[21] Appl. No.: 832,948

[22] Filed: Feb. 26, 1986

[30] Foreign Application Priority Data

Feb. 26, 1985 [GB] United Kingdom ..... 8504949

[51] Int. Cl.[4] ..... E21B 47/02

[52] U.S. Cl. ..... 33/302; 33/313

[58] Field of Search ..... 33/302, 303, 304, 312, 33/313, 356

[56] References Cited

U.S. PATENT DOCUMENTS

| | | | |
|---|---|---|---|
| 3,862,499 | 1/1975 | Isham et al. | 33/312 |
| 3,935,642 | 2/1976 | Russell | 33/312 |
| 4,163,324 | 8/1979 | Russell et al. | 33/313 |
| 4,345,454 | 8/1982 | Brown | 33/313 |
| 4,414,753 | 11/1983 | Moulin et al. | 33/356 |
| 4,472,884 | 9/1984 | Engebretson | 33/304 |
| 4,510,696 | 4/1985 | Roesler | 33/313 |
| 4,559,713 | 12/1985 | Ott et al. | 33/302 |

FOREIGN PATENT DOCUMENTS

| | | | |
|---|---|---|---|
| 2122751 | 1/1984 | United Kingdom | 33/304 |
| 2138141 | 10/1984 | United Kingdom | 33/304 |

*Primary Examiner*—Richard R. Stearns

[57] ABSTRACT

A method for eliminating the influence of drill string magnetization on an azimuth measurement made by a magnetometer package disposed in the drill string. The method comprises first eliminating the influence of the cross-axial components of the drill string magnetization by taking magnetometer readings at various angular orientations of the drill string and then eliminating the influence of the axial component of the drill string magnetization.

9 Claims, 6 Drawing Figures

METHOD FOR DETERMINING THE AZIMUTH OF A BOREHOLE

BACKGROUND OF THE INVENTION

The invention relates to a method for determining the azimuth of a borehole that is being drilled in a subsurface earth formation.

The invention relates in particular to a method for determining and correcting the influence of the erroneous magnetic field caused by magnetization of a drill string on an azimuth measurement made by a magnetic sensor package included in the drill string.

During deephole drilling operations it is general practice to survey from time to time the course of the borehole by means of a sensor package which is included in the drill string near the lower end thereof. The sensor package generally comprises a set of magnetometers that measure the components of the local magnetic field in three orthogonal directions. These measurements together with the direction of the earth magnetic field vector, and the direction of the local gravity vector, provide a suitable reference to determine the course of the borehole.

When measuring the orientation of the sensor package relative to the earth magnetic field vector while the drill string is present in the borehole the erroneous magnetic field caused by drill string magnetization may cause a significant error in the measurement. To reduce the magnitude of this error as much as possible it is current practice to arrange the sensor package in a drill collar which is made of non-magnetic material. Moreover, this collar is usually arranged in a drill string section comprising a series of non-magnetic collars to reduce the impact of the steel components of the drilling assembly, such as the drill bit and the drill pipes above the collars, on the magnetic field at the location of the sensors. A problem encountered when using non-magnetic drill collars is that these collars may become magnetized during drilling and in particular, the presence of so-called magnetic spots in the collar near the sensor assembly may impair the accuracy of the azimuth measurement considerably.

U.S. Pat. No. 4,163,324 describes a method for partially eliminating the error in the azimuth measurement caused by the erroneous magnetic field at the location of the sensor package, which field mainly is the result of drill string magnetization. In the patented method it is assumed that at the location of the sensors the vector of the erroneous magnetic field is oriented along the borehole axis. Although the known correction method generally enhances the accuracy of the azimuth measurement it does not correct for cross-axial magnetic error field. Said cross-axial magnetic error fields can originate from the presence of magnetic spots or steel components in the drilling assembly.

SUMMARY OF THE INVENTION

The invention aims to provide an improved azimuth measurement wherein the error caused by drill string magnetization is corrected for in a more accurate manner than in the prior art method.

In accordance with the invention there is provided a method of determining the influence of drill string magnetization on an azimuth measurement in a borehole by means of a sensor package included in a drill string. The package has a central axis z substantially coaxial to the longitudinal axis of the borehole, and comprises at least one magnetometer for measuring a cross-axial component of the magnetic field $\vec{B}_m$ at the location of the sensor package. The method comprising eliminating the influence of both the cross-axial and the axial components of the drill string magnetization at the location of the magnetometer. Prior to eliminating the influence of axial drill string magnetization the influence of cross-axial drill string magnetization is eliminated by rotating the drill string with the included sensor package about the longitudinal axis in the borehole while measuring said cross-axial component of the magnetic field for various orientations of the drill string.

In a preferred embodiment of the invention the sensor package comprises three magnetometers for measuring the components $B_x$, $B_y$ and $B_z$ in three mutually orthogonal directions x, y and z, wherein the influence of the cross-axial error components $M_x$ and $M_y$ caused by drill string magnetization on the measured magnetic field is determining by plotting, in a diagram having $B_x$ as abscis and $b_y$ as ordinate, the measured cross axial components $B_x$ and $B_y$ of the magnetic field at various orientations of the sensor package in the borehole. If the drill string is rotated over an angular interval of about 360 degrees a closed spherical curve can be drawn in the diagram through the cross-axial components $B_x$ and $B_y$ thus measured, whereupon the cross-axial error components $M_x$ and $M_y$ of the drill string magnetization vector $\vec{M}$ can be determined on the basis of the center of the curve in the diagram.

BRIEF DESCRIPTION OF THE DRAWINGS

The invention will now be described in more detail with reference to the accompanying drawings, in which.

DESCRIPTION OF PREFERRED EMBODIMENTS

Figure 1:
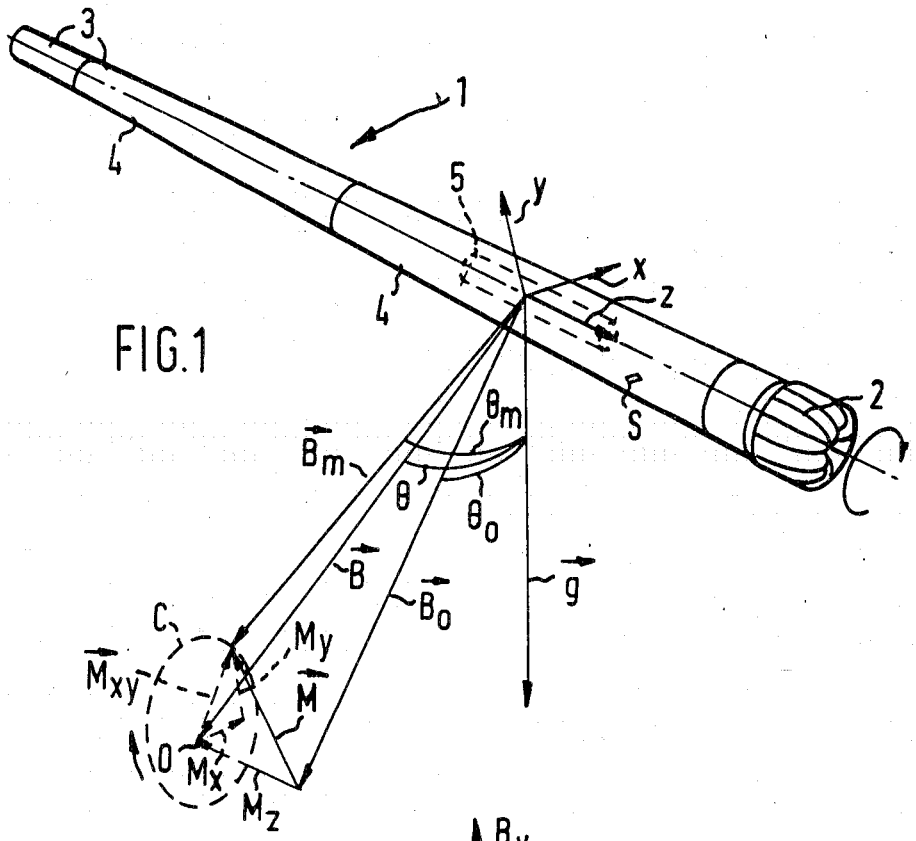
FIG. 1 is a schematic perspective view of a drill string including a tri-axial survey instrument.

In FIG. 1 there is shown a drilling assembly 1 comprising a drill bit 2 which is coupled to the lower end of a drill string 3. The lowermost section of the drill string 3 includes two non-magnetic drill collars 4. In one of the non-magnetic drill collars 4 a tri-axial survey instrument 5 is arranged, which instrument is used to determine the azimuth and inclination of the central axis z of the collar 4, which axis is substantially coaxial to the longitudinal axis of the borehole at the location of the bit 2.

The survey instrument 5 comprises three accelerometers (not shown) arranged to sense components of gravity in three mutually orthogonal directions x, y and z, and three magnetometers (not shown) arranged to measure the magnetic field at the location of the instrument in the same three mutually orthogonal directions.

In FIG. 1 there is illustrated the gravity vector $\vec{g}$ measured by the instrument 5, which vector $\vec{g}$ equals the vector sum of the components $g_x$, $g_y$ and $g_z$ measured by the accelerometers, and the vector $\vec{B}_m$ of the local magnetic field, which vector $\vec{B}_m$ equals the vector sum of the components $B_x$, $B_y$ and $B_z$ measured by the magnetometers of the instrument 5. As illustrated the vector $\vec{B}_m$ is oriented at an angle $\theta_m$ relative to the gravity vector $\vec{g}$, which angle can be calculated on the basis of known mathematical formulas.

In FIG. 1 there is also illustrated the vector $\vec{B}_o$ of the true earth magnetic field and the dip angle $\theta_o$ of this vector relative to the gravity vector $\vec{g}$. The magnitude of the vector $\vec{B}_o$ and the orientation thereof relative to the gravity vector $\vec{g}$ can be obtained independently from the borehole measurement, for example from measurements outside or inside the borehole or from geomagnetic mapping data.

As can be seen in FIG. 1 the measured magnetic field vector $\vec{B}_m$ does not coincide with the true magnetic field vector $\vec{B}_o$. This is caused by the erroneous magnetic field $\vec{M}$ at the location of the instrument, which field is mainly a consequence of the presence of isolated magnetic spots S in the non-magnetic drill collars 4 and of the presence of steel components in the drilling assembly 1. In FIG. 1 the vector $\vec{M}_{xy}$, which cross-axial vector $\vec{M}_{xy}$ equals the vector sum of the components $M_x$ and $M_y$.

In accordance with the invention the influence of the erroneous magnetic field $\vec{M}$ is eliminated by first determining the cross-axial vector $\vec{M}_{xy}$ and then determining the axial component $M_z$ of the erroneous field.

Determination of the cross-axial vector $\vec{M}_{xy}$ is carried out by rotating the drill string over about 360 degrees, thereby rotating simultaneously the instrument 5 about the central axis z, while measuring continuously or intermittently the magnetic field $\vec{B}_m$ for various orientations of the instrument 5 relative to the central axis z. As illustrated in FIG. 1 rotation of the drilling assembly over 360 degrees in the direction of the arrow will cause the vector $\vec{M}_{xy}$ to rotate simultaneously in the same direction, thereby describing a circle C. The magnitude and direction of the vector $\vec{M}_{xy}$ is determined from the plotted diagram, shown in FIG. 2, in which the cross-axial componentas $B_x$ and $B_y$ of the measured magnetic field $\vec{B}_m$ are plotted for various orientations of the instrument relative to the central axis z. In the plotted diagram the measured values of $B_x$ and $B_y$ lie on a circle which is located eccentrically relative to the center (0,0) of the diagram. The vector $\vec{M}_{xy}$ is subsequently determined on the basis of the location of the circle-center 10 relative to the center (0,0) of the diagram. As illustrated the magnitude of the vector $M_{xy}$ is determined from the distance between the circle-center 10 and the center (0,0) of the diagram.

Now a vector B is introduced in the vector diagram of FIG. 1, which vector B equals $B_m - M_{xy}$.

$$M_{xy}=(M_x, M_y, 0)$$

and $$B_m=(B_x, B_y, B_z)$$

the vector B can be expressed through $$B=(, B_x, B_y, B_z)-(M_x, M_y, 0).$$

Defining now the components $$B_x - M_x \text{ as } B_{xc}$$

and $$B_y - M_y \text{ as } B_{yc}$$

gives:

$$B=(B_{xc}, B_{yc}, B_z)=(B_x, B_yB_z)-(M_x, M_y, 0) \quad (1)$$

Equation (1) provides a correction for the influence of cross-axial drill string magnetization on the magnetic field measured by the survey instrument 5.

After having thus eliminated the influence of cross-axial drill string magnetization $M_{xy}$ on the survey measurement, the influence of the axial error component $M_z$ may be corrected for by a correction method similar to the method disclosed in U.S. Pat. No. 4,163,324.

It is preferred, however, to correct the survey measurement by the instrument 5 for axial drill string magnetization by means of the calculation method described hereinbelow with reference to FIG. 3.

The magnitude of the vector B can be expressed by:

$$B=(B_{xc}^2+B_{yc}^2+B_z^2)^{\frac{1}{2}} \quad (2)$$

and the magnitude of the gravity vector g by:

$$g=(g_x^2+g_y^2+g_z^2)^{\frac{1}{2}} \quad (3)$$

which enables calculating a dip angle $\theta$ between the vectors B and g through the formula:

$$\theta=\cos^{-1}[(B_{xc}g_x+B_{yc}g_y+B_zg_z)/Bg] \quad (4)$$

Figure 3:
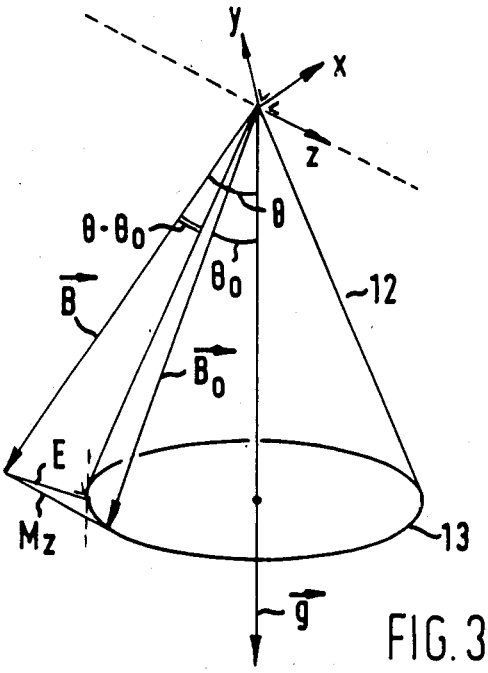
FIG. 3 is a vector diagram illustrating the position of the vector of the measured magnetic field, corrected for cross-axial drill string magnetization, relative to a cone defined by the gravity vector and the vector of the earth magnetic field.

The angle $\theta$ is indicated in FIG. 1 and also in FIG. 3, which is a similar but simplified representation of the vector diagram shown in FIG. 1.

Determination of the position of the vector $\vec{B}_o$ relative to the vector $\vec{B}$ is complicated by the fact that the vector $\vec{B}$ is only defined by its orientation at a dip angle $\theta$ relative to the gravity vector $\vec{g}$. Moreover, the exact orientation of the true magnetic field vector $\vec{B}_o$ relative to the axes x, y and z is still unknown. However, as the true magnetic field vector $\vec{B}_o$ is oriented at an angle $\theta_o$ relative to the gravity vector $\vec{g}$ it is understood that in the vector diagram of FIG. 3 the vector $\vec{B}_o$ will lie on a cone 12 having a central axis coinciding with the vector $\vec{g}$ and a top angle that equals $2\theta_o$. The angle $\theta_o$ is known as it has been obtained independently from the borehole measurement.

Now the distance E is introduced in the vector diagram where E indicates the distance between the base circle 13 of the cone 12 and the terminal point of the vector $\vec{B}$.

The magnitude of the distance E is given by the equation $$E=[B^2+B_o^2-2BB_o\cos(\theta-\theta_o)]^{\frac{1}{2}} \quad (5)$$

Figure 4:
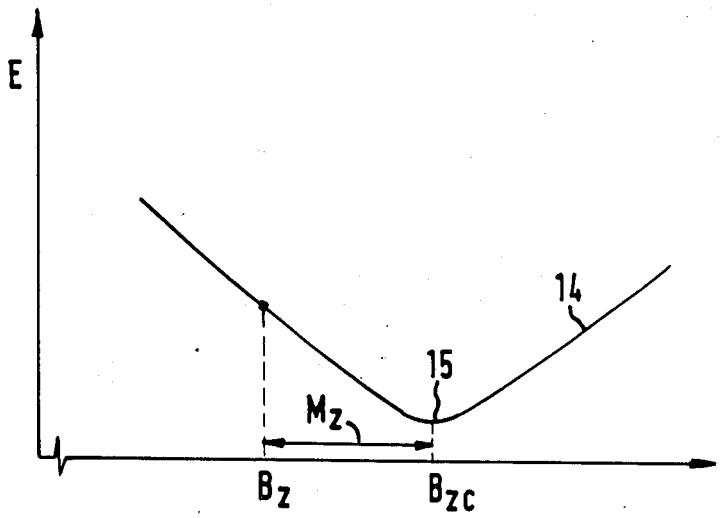
FIG. 4 is a diagram in which the distance between the base circle of the cone and said corrected vector is calculated for various assumed magnitudes of axial drill string magnetization.

The value for E thus found is now plotted in the diagram shown in FIG. 4, in which $B_z$ is the abscis and E the ordinate.

The next step is to assume that the axial component $B_z$ of the magnetic field measured by the instrument 5 may vary as a result of the axial component $M_z$ of the erroneous field. Then various assumed values are taken for $B_z$ and for each assumed value the corresponding value of the distance E is calculated through equations (2), (3), (4) and (5). The various values thus found for E are plotted in the diagram of FIG. 4 which will provide a plotted curve 14 in which at a certain value $B_{zc}$ of $B_z$ a minimum 15 occurs. The magnitude of the axial component $M_z$ of the erroneous field can now be determined from the plotted diagram as it equals the distance between $B_z$ and $B_{zc}$, since $B_{zc}=B_z-M_z$.

After thus having determined the magnitude $B_{zc}$ of the axial component of the magnetic field at the location of the instrument 5 the azimuth of the borehole is calculated on the basis of known formulas using the corrected values $B_{xc}$, $B_{yc}$, $B_{zc}$.

It is observed that the sensor package may be included in the drill string in various ways. The package may be suspended in the drill string by means of a wireline and locked to the non-magnetic sections as shown in prior art, wherein the signals produced by the sensors are transmitted to the surface via the wireline. The package may also be fixedly secured to the drill string or dropped to a selected location inside the drill string, wherein the signals produced by the sensors are either transmitted to the surface via a wireless telemetry system or stored in a memory assembly and then read out after retrieval of the drilling assembly from the borehole.

Figure 2:
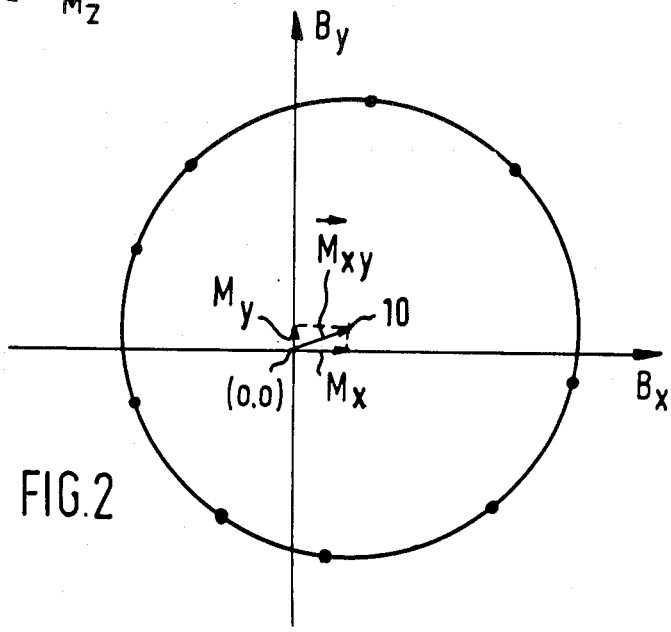
FIG. 2 is a diagram in which the cross-axial magnetic field measured by the cross-axial sensors is plotted while the drill string is rotated in the borehole.

Furthermore, it will be appreciated that instead of plotting the diagrams shown in FIGS. 2 and 4 computerized calculations procedures may be used to determine said corrected components $B_{xc}$, $B_{yc}$ and $B_{zc}$ of the magnetic field.

Figure 5:
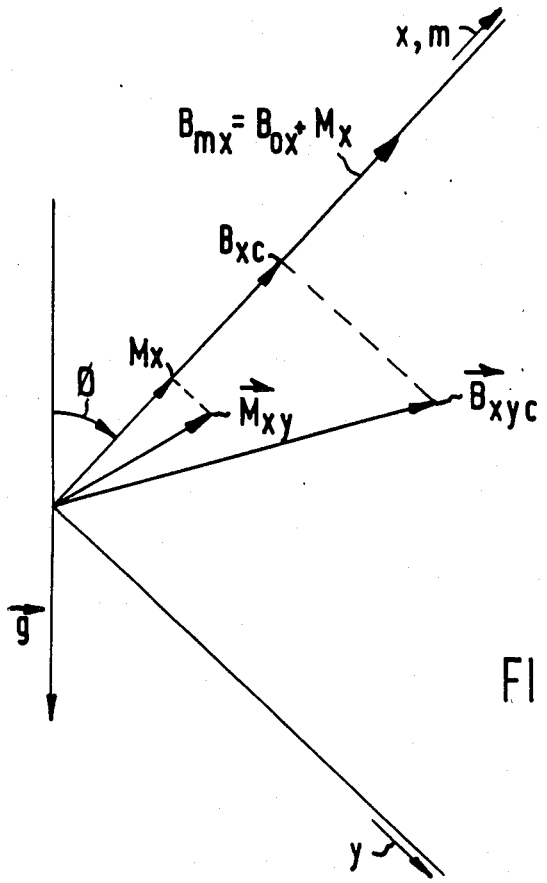
FIG. 5 illustrates an alternative embodiment of the invention wherein the sensor package includes a single magnetometer.
Figure 6:
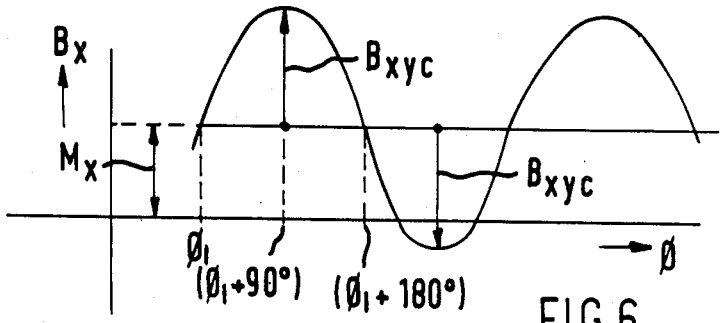
FIG. 6 illustrates the magnetometer readings of the instrument of FIG. 5 for various orientations of the instrument obtained by rotating the drill string.

Moreover, as will be explained with reference to FIGS. 5 and 6 corrected cross-axial values $B_{xc}$ and $B_{yc}$ for the cross-axial components of the measured magnetic field can be obtained in an inclined borehole with a survey instrument comprising a single magnetometer. In the embodiment shown in FIG. 5 the survey instrument includes a single magnetometer and two mutually orthogonal accelerometers which are all arranged in a single plane cross-axial to the longitudinal axis of the drill string. The accelerometers are oriented along mutually orthogonal axes x and y, and the magnetometer axis m is parallel to the x-axis accelerometer. As illustrated in FIG. 5 the magnetic field component $B_{mx}$ measured by the magnetometer equals the sum of the x-component $B_{ox}$ of the earth magnetic field $\vec{B}_o$ and the x-component $M_x$ of the erroneous field $\vec{M}$ caused by drill string magnetization. When the drill string is rotated in the borehole the magnetometer, which is stationary relative to the drill string, reads a constant magnetic field contribution $M_x$ for every gravity high-side angle $\phi$ as determined with the x-axis and y-axis accelerometers. In addition, the magnetometer simultaneously reads a sinusoidal varying magnetic field contribution $B_{ox}$ of the earth magnetic field $\vec{B}_o$. When the drill string is rotated over about 360 degrees relative to the longitudinal axis of the inclined borehole, the magnetometer reads as illustrated in FIG. 6 a sinusoidal varying magnetic field with amplitude $B_{xyc}$ and zero offset $M_x$ versus the gravity high-side angle $\phi$. For a selected angular orientation of the drill string in the borehole and consequently a selected gravity high-side angle $\phi_1$, $B_{xc}$ is obtained by correcting the magnetometer reading for the zero-offset $M_x$. $B_{yc}$ is subsequently obtained from the diagram shown in FIG. 6 by correction of the magnetometer reading for zero offset $M_x$ at a gravity high-side angle 90 degrees away from the selected orientation of the drill string.

What is claimed is:

1. A method for eliminating the influence of drill string magnetization on an azimuth measurement made by a magnetometer package fixedly mounted to a drill string, said method comprising:

rotating the drill string;

measuring a cross-axial component $B_m$ of a magnetic field B for various rotational orientations of the drill string;

determining a portion of the measured cross-axial component $B_m$ produced by a cross-axial drill string magnetization $M_{xy}$;

utilizing the cross-axial drill string magnetization $M_{xy}$ to eliminate its influence on azimuth measurements.

2. The method of claim 1, wherein the components $B_x$, $B_y$ and $B_z$ of the magnetic field $\vec{B}_m$ in three mutually orthogonal directions x, y and z are measured, and wherein the influence of the cross-axial error components $M_x$ and $M_y$ of the drill string magnetization on the measured magnetic field is determined in a diagram having $B_x$ as abscis and $B_y$ of the magnetic field measured at various orientations of the sensor package in the borehole are plotted.

3. The method of claim 2, wherein the drill string is rotated relative to the central axis z over an angular interval of about 360 degrees, and wherein in the diagram a closed spherical curve is drawn through the cross-axial components $B_x$ and $B_y$ of the magnetic field measured for various orientations of the drill string, and the cross-axial error components $M_x$ and $M_y$ of the drill string magnetization vector $\vec{M}$ are determined on the basis of the position of the center of the curve in the diagram.

4. The method as claimed in claim 3, wherein the cross-axial error components $M_x$ and $M_y$ of the drill string magnetization vector $\vec{M}$ are subtracted from the cross-axial components $B_x$ and $B_y$ of the measured magnetic field, thereby assessing corrected cross-axial values $B_{xc}$ and $B_{yc}$ for the cross-axial components of the measured magnetic field, and producing a vector ($B_{xc}$, $B_{yc}$, $B_z$) corrected for the cross-axial drill string magnetization expressed by the formula:

$$(B_{xc}, B_{yc}, B_z)=(B_x, B_y, B_z)-(M_x M_y, 0).$$

5. The method as claimed in claim 4, wherein the magnetometer package is provided with three magnetometers having their axes disposed orthogonally and three gravity sensors for determining the cross-axial and axial components $g_x$, $g_y$, $g_z$ of the local gravity vector $\vec{g}$ and wherein the portion of axial component $\vec{B}_z$ of the magnetic field $\vec{B}$ produced by the axial drill string magnetization is determined by the steps of:

calculating the gravity field strength g through: $g=(g_x^2+g_y^2+g_z^2)^{\frac{1}{2}}$, calculating the magnetic field strength B corrected for cross-axial drill string magnetization through: $B=(B_{xc}^2+B_{yc}^2+B_z^2)^{\frac{1}{2}}$ and subsequently calculating a dip angle $\theta$ between the vectors $\vec{B}$ and $\vec{g}$ through: $\theta=\cos^{-1}[(B_{xc}g_x+B_{yc}g_y+B_z g_z)/Bg]$ obtaining independently from the measurements in the borehole the true magnitude $\vec{B}_o$ of the earth magnetic field and the dip angle $\theta_o$ between the vectors $\vec{B}_o$ and $\vec{g}$ and defining in a vector diagram a cone having a central axis defined by the gravity vector $\vec{g}$ and enveloped by $\vec{B}_o$, the top angle of the cone being equal to $2\theta_o$;

representing in the same vector diagram the vector $\vec{B}$ which extends from the top of the cone at an angle $\theta$ relative to the gravity vector $\vec{g}$;

expressing the distance E between the vector $\vec{B}$ and the base circle of the cone by the formula: $E=[B^2+B_o^2-2BB_o\cos(\theta-\theta_o)]^{\frac{1}{2}}$;

calculating E for various assumed magnitudes of $B_z$ on the basis of said formulas for B, g, $\theta$ and E and plotting in a diagram, having an abscis representing magnitudes of $B_z$ and an ordinate representing magnitudes of E, the various magnitudes for E thus calculated for various magnitudes of $B_z$, determining in the plotted diagram a minimum magnitude for the distance E and assessing the magnitude of $B_z$ that corresponds to the minimum magnitude for E as the corrected magnitude $B_{zc}$ of the axial component of the magnetic field measured by the sensor package; and determining the azimuth of the borehole on the basis of the corrected magnitudes $B_{xc}$, $B_{yc}$, $B_{zc}$ of the components of the magnetic field measured by the sensor package.

6. The method as claimed in claim 1, wherein the magnetometer package includes a single magnetometer for measuring one cross-axial component of the magnetic field $\vec{B}$ at the location of the sensor package.

7. A method for eliminating the influence of drill string magnetization on an azimuth measurement made by a magnetometer package fixedly mounted to a drill string, said method comprising:

rotating the drill string over an angular interval of about 360° and measuring components $B_x$, $B_y$ and $B_z$ of a magnetic field $\vec{B}$ in three mutually orthogonal directions x, y and z, corresponding to separate magnetometers, with the z axis as the central axis of the drill string;

determining the position of the measured cross-axial component $\vec{B}_m$ produced by the cross-axial drill string magnetization $M_{xy}$, by the steps comprising:

defining a closed spherical curve from the measurements of $B_x$ and $B_y$ for various orientations of a sensor package in the borehole where $B_x$ is the abscis and $B_y$ is the ordinate;

determining the cross-axial error components $M_x$ and $M_y$ of the drill string magnetization vector $\vec{M}$ on the basis of the position of the center of the closed spherical curve in relation to the origin of the $B_x$ and $B_y$ axes;

utilizing the cross-axial drill string magnetization $M_{xy}$ to eliminate its influence on azimuth measurements by subtracting the cross-axial error components $M_x$ and $M_y$ of the drill string magnetization $\vec{M}$ from the cross-axial components $B_x$ and $B_y$ of the measured magnetic field, thereby assessing corrected axial values $B_{xc}$ and $B_{yc}$ for the axial-components of the measured magnetic field, and producing a vector ($B_{xc}$, $B_{yc}$, $B_z$) corrected for the cross-axial drill string magnetization expressed by the formula:

$$(B_{xc}, B_{yc}, B_z)=(B_x, B_y, B_z)-(M_x, M_y, 0);$$

determining the corrected magnitude $B_{zc}$ of the axial component of the magnetic field by eliminating the axial component in the magnitude of $B_z$ resulting from drill string magnetization, comprising the following steps:

measure components $g_x$, $g_y$, $g_z$ of the local gravity $\vec{g}$ in three mutually orthogonal directions x, y and z, with z as the axis of the drill string and corresponding to three separate gravity meters;

calculating the gravity field strength g through: $g=(g_x^2+g_y^2+g_z^2)^{\frac{1}{2}}$, *calculating the magnetic field strength B corrected for cross-axial drill string magnetization through:* $B=(B_{xc}^2+B_{yc}^2+B_z^2)^{\frac{1}{2}}$; and subsequently calculating a dip angle $\theta$ between the vectors $\vec{B}$ and $\vec{g}$ through: $\theta=\cos^{-1}[(B_{xc}g_x+B_{yc}g_y+B_zg_z)/Bg]$;

obtaining independently from the measurements in the borehole the true magnitude $\vec{B}_o$ of the earth magnetic field and the dip angle $\theta_o$ between the vectors $\vec{B}_o$ and $\vec{g}$ defining in a vector diagram a cone having a central axis defined by the gravity vector $\vec{g}$ and enveloped by $\vec{B}_o$, the top angle of the cone being equal to $2\theta_o$;

representing in the same vector diagram the vector $\vec{B}$ which extends from the top of the cone at an angle $\theta$ relative to the gravity vector $\vec{g}$;

expressing the distance E between the vector $\vec{B}$ and the base circle of the cone by the formula:

$$E=[B^2+B_o^2-2BB_o\cos(\theta-\theta_o)]^{\frac{1}{2}};$$

and calculating E for various assumed magnitudes of $B_z$ on the basis of said formulas for B, g, $\theta$ and E and plotting in a diagram, having an abscis representing magnitudes of $B_z$ and an ordinate representing magnitudes of E, the various magnitudes for E thus calculated for various magnitudes of $B_z$, determining in the plotted diagram a minimum magnitude for the distance E and assessing the magnitude of $B_z$ that corresponds to the minimum magnitude for E as the corrected magnitude $B_{zc}$ of the axial component of the magnetic field measured by the sensor package; and defining the azimuth of the borehole on the basis of the corrected magnitudes $B_{xc}$, $B_{yc}$, $B_{zc}$ of the components of the magnetic field measured by the sensor package.

8. A method for eliminating the influence of drill string magnetization in an azimuth measurement made by a magnetometer package fixedly mounted in a drill string, said method comprising:

rotating the drill string;

measuring a cross-axial component $\vec{B}_m$ of a magnetic field $\vec{B}$ for various rotational orientations of the drill string;

determining the portion of the measured cross-axial component $\vec{B}_m$ produced by a cross-axial drill string magnetization $\vec{M}_{xy}$ to eliminate its influence on azimuth measurements thereby assessing corrected cross-axil values $B_{xc}$ and $B_{yc}$ for the cross-axial components of the measured magnetic field;

determining the portion of an axial-component $\vec{B}_z$ of the magnetic field $\vec{B}$ produced by an axial drill string magnetization utiltizing three gravity sensors for determining the cross-axial and axial components $g_x$, $g_y$, $g_z$ of the local gravity vector $\vec{g}$ by the steps of:

calculating the gravity field strength g through: $g=(g_x^2+g_y^2+g_z^2)^{\frac{1}{2}}$, calculating the magnetic field strength B corrected for cross-axial drill string magnetization through: $B=(B_{xc}^2+B_{yc}^2+B_z^2)^{\frac{1}{2}}$; and subsequently calculating a dip angle $\theta$ between the vectors $\vec{B}$ and $\vec{g}$ through: $\theta=\cos^{-1}[(B_{xc}g_x+B_{yc}g_y+B_zg_z)/Bg]$;

obtaining independently from the measurements in the borehole the true magnitude $\vec{B}_o$ of the earth magnetic field and the dip angle $\theta_o$ between the vectors $\vec{B}_o$ and $\vec{g}$ and defining in a vector diagram a cone having a central axis defined by the gravity vector $\vec{g}$ and enveloped by $\vec{B}_o$, the top angle of the cone being equal to $2\theta_o$;

representing in the same vector diagram the vector $\vec{B}$ which extends from the top of the cone at an angle $\theta$ relative to the gravity vector $\vec{g}$;

expressing the distance E between the vector $\vec{B}$ and the base circle of the cone by the formula:

$$E=[B^2+B_o^2-2BB_o\cos(\theta-\theta_o)]^{\frac{1}{2}};$$

calculating E for various assumed magnitudes of $B_z$ on the basis of said formulas for B, g, $\theta$ and E and plotting in a diagram, having an abscis representing magnitudes of $B_z$ and an ordinate representing magnitudes of E, the various magnitudes for E thus calculated for various magnitudes of $B_z$, determining in the plotted diagram a minimum magnitude for the distance E and assessing the magnitude of $B_z$ that corresponds to the minimum magnitude for E as the corrected magnitude $B_{zc}$ of the axial component of the magnetic field measured by the sensor package; and determining the azimuth of the borehole on the basis of the corrected magnitudes $B_{xc}$, $B_{yc}$, $B_{zc}$ of the components of the magnetic field $\vec{B}_m$ measured by the sensor package.

9. A method for eliminating the influence of drill string magnetization on an azimuth measurement made by a magnetometer package fixedly mounted in a drill string, said method comprising:

rotating the drill string;

measuring a cross-axial component $\vec{B}_m$ of a magnetic field $\vec{B}$ for various rotational orientations of the drill string;

determining the portion of the measured cross-axial component $\vec{B}_m$ produced by a cross-axial drill string magnetization $\vec{M}_{xy}$;

utilizing the cross-axial drill string magnetization $\vec{M}_{xy}$ to eliminate its influence on azimuth measurements;

determining the portion of an axial-componenet $\vec{B}_z$ of the magnetic field $\vec{B}$ produced by an axial drill string magnetization $\vec{M}_z$; and utilizing the axial drill string magnetization $\vec{M}_z$ to eliminate its influence on azimuth measurements.

* * * * *